US009180998B2

(12) United States Patent
Banks et al.

(10) Patent No.: US 9,180,998 B2
(45) Date of Patent: Nov. 10, 2015

(54) INSULATED PALLET SHIPPER AND METHODS OF MAKING AND USING THE SAME

(75) Inventors: Mark Banks, Millis, MA (US); Neritan Mustafa, Milford, MA (US); Lawrence A. Gordon, Southborough, MA (US); Jeffrey D. Simpson, Woburn, MA (US); Richard M. Formato, Grafton, MA (US)

(73) Assignee: COLD CHAIN TECHNOLOGIES, INC., Holliston, MA (US)

( * ) Notice: Subject to any disclaimer, the term of this patent is extended or adjusted under 35 U.S.C. 154(b) by 1229 days.

(21) Appl. No.: 12/733,634

(22) PCT Filed: Sep. 11, 2008

(86) PCT No.: PCT/US2008/010660

§ 371 (c)(1),
(2), (4) Date: Sep. 13, 2010

(87) PCT Pub. No.: WO2009/035661

PCT Pub. Date: Mar. 19, 2009

(65) Prior Publication Data

US 2011/0049164 A1 Mar. 3, 2011

Related U.S. Application Data

(60) Provisional application No. 60/993,419, filed on Sep. 11, 2007, provisional application No. 61/188,565, filed on Aug. 11, 2008.

(51) Int. Cl.
*F25D 3/06* (2006.01)
*B65D 19/44* (2006.01)
(Continued)

(52) U.S. Cl.
CPC ..... *B65D 19/44* (2013.01); *B65D 19/02* (2013.01); *B65D 81/3823* (2013.01); *F25D 3/08* (2013.01);
(Continued)

(58) Field of Classification Search
CPC ..... F25D 2303/083; F25D 2303/0822; F25D 2303/0832; F25D 2303/0844; B65D 81/18
USPC ..... 62/371–372, 60, 529–530
See application file for complete search history.

(56) References Cited

U.S. PATENT DOCUMENTS 1,865,688 A * 7/1932 Hannaford ..... 62/371
2,087,966 A 7/1937 Clark
(Continued)

FOREIGN PATENT DOCUMENTS

AU 4085772 A 3/1972
CA 1298564 A 4/1992
(Continued)

OTHER PUBLICATIONS

English Translation of JP 2003-096442 to Oizumi, Publication date: Apr. 2003, Translated Apr. 2014.*
(Continued)

*Primary Examiner* — Cassey D Bauer
(74) *Attorney, Agent, or Firm* — Kriegsman & Kriegsman

(57) ABSTRACT

Insulated pallet shipper and methods of making and using the same. The insulated pallet shipper includes an insulated container shaped to include a bottom wall, a top wall, a left side wall, a right side wall, a rear wall and a front wall, the walls collectively defining a cavity; a plurality of coolant members positioned in the cavity, each of the coolant members including a plurality of coolant bricks encased within a cardboard container, at least some of the coolant members being preconditioned at a refrigerating temperature and at least some of the coolant members being preconditioned at a freezing temperature; an inner pallet seated on the bottom wall; and an outer pallet upon which the container is seated.

19 Claims, 17 Drawing Sheets

(51) Int. Cl.
*B65D 19/02* (2006.01)
*B65D 81/38* (2006.01)
*F25D 3/08* (2006.01)

(52) U.S. Cl.
CPC ..... *B65D 2519/00044* (2013.01); *B65D 2519/00079* (2013.01); *B65D 2519/0086* (2013.01); *B65D 2519/00184* (2013.01); *B65D 2519/00218* (2013.01); *B65D 2519/00273* (2013.01); *B65D 2519/00293* (2013.01); *B65D 2519/00323* (2013.01); *B65D 2519/00338* (2013.01); *B65D 2519/00502* (2013.01); *B65D 2519/00532* (2013.01); *B65D 2519/00606* (2013.01); *B65D 2519/00616* (2013.01); *B65D 2519/00666* (2013.01); *B65D 2519/00711* (2013.01); *F25D 2303/0843* (2013.01); *F25D 2303/0844* (2013.01); *F25D 2303/0845* (2013.01); *F25D 2303/08221* (2013.01)

(56) References Cited

U.S. PATENT DOCUMENTS

| | | | | | |
|---|---|---|---|---|---|
| 2,317,005 | A | | 4/1943 | Wasserman | |
| 2,325,371 | A | | 7/1943 | Clerc | |
| 2,467,268 | A | * | 4/1949 | Merkle | 62/372 |
| 2,631,439 | A | * | 3/1953 | Feigenbaum | 62/372 |
| 2,728,200 | A | * | 12/1955 | Lobl | 62/372 |
| 2,915,235 | A | | 12/1959 | Rueckert | |
| 2,989,856 | A | * | 6/1961 | Telkes | 62/371 |
| 3,205,033 | A | | 9/1965 | Stentz | |
| 3,651,974 | A | | 3/1972 | Barry et al. | |
| 4,090,659 | A | | 5/1978 | Galmiche et al. | |
| 4,294,079 | A | | 10/1981 | Benson | |
| 4,377,075 | A | | 3/1983 | Russo | |
| 4,741,167 | A | | 5/1988 | Wigley | |
| 4,887,731 | A | | 12/1989 | Pett et al. | |
| 4,947,658 | A | | 8/1990 | Wheeler et al. | |
| 5,507,405 | A | | 4/1996 | Thomas et al. | |
| 5,669,233 | A | | 9/1997 | Cook et al. | |
| 5,791,150 | A | | 8/1998 | Bosher et al. | |
| 5,809,906 | A | * | 9/1998 | Janek | 108/57.15 |
| 5,881,908 | A | | 3/1999 | Hays et al. | |
| 5,897,017 | A | | 4/1999 | Lantz | |
| 5,899,088 | A | * | 5/1999 | Purdum | 62/371 |
| 5,924,302 | A | | 7/1999 | Derifield | |
| 5,950,450 | A | | 9/1999 | Meyer et al. | |
| 5,953,928 | A | | 9/1999 | Saia, III et al. | |
| 5,983,661 | A | | 11/1999 | Wiesman | |
| 5,987,910 | A | | 11/1999 | Kothe et al. | |
| 6,016,664 | A | | 1/2000 | Larsson et al. | |
| 6,257,764 | B1 | | 7/2001 | Lantz | |
| 6,266,972 | B1 | | 7/2001 | Bostic | |
| 6,325,281 | B1 | | 12/2001 | Grogan | |
| 6,558,608 | B2 | | 5/2003 | Haraldsson et al. | |
| 6,584,797 | B1 | | 7/2003 | Smith et al. | |
| 6,666,032 | B1 | | 12/2003 | Rickson et al. | |
| 6,832,562 | B2 | | 12/2004 | Tabor et al. | |
| 6,868,982 | B2 | | 3/2005 | Gordon | |
| 7,028,504 | B2 | | 4/2006 | Derifield | |
| 7,225,632 | B2 | | 6/2007 | Derifield | |
| 7,257,963 | B2 | | 8/2007 | Mayer | |
| 7,310,967 | B2 | | 12/2007 | Aragon | |
| 7,328,583 | B2 | | 2/2008 | Hillman et al. | |
| 7,631,799 | B2 | | 12/2009 | Turvey et al. | |
| 7,721,566 | B1 | | 5/2010 | Wilken | |
| 7,913,511 | B2 | | 3/2011 | Meyer et al. | |
| 8,607,581 | B2 | | 12/2013 | Williams et al. | |
| 8,672,137 | B2 | | 3/2014 | Seagle et al. | |
| 8,763,423 | B2 | | 7/2014 | Tattam | |
| 8,763,886 | B2 | | 7/2014 | Hall | |
| 2003/0012701 | A1 | | 1/2003 | Sangha et al. | |
| 2003/0217948 | A1 | | 11/2003 | Lantz | |
| 2007/0051734 | A1 | | 3/2007 | Kuhn | |
| 2008/0276643 | A1 | * | 11/2008 | Heroux et al. | 62/457.2 |
| 2010/0301057 | A1 | | 12/2010 | Tattam et al. | |
| 2013/0015191 | A1 | | 1/2013 | Seagle et al. | |
| 2013/0255306 | A1 | | 10/2013 | Mayer | |
| 2014/0174692 | A1 | | 6/2014 | Emond et al. | |

FOREIGN PATENT DOCUMENTS

| | | | | | |
|---|---|---|---|---|---|
| FR | 2 759 676 | A1 | | 8/1998 | |
| FR | 2989359 | A1 | | 10/2013 | |
| GB | 1061791 | A | | 3/1967 | |
| JP | 2003-096442 | | * | 4/2003 | B65D 81/18 |
| WO | 9843028 | A1 | | 10/1998 | |
| WO | WO 2006/082433 | A1 | | 8/2006 | |
| WO | 2014083320 | A1 | | 6/2014 | |

OTHER PUBLICATIONS http://www.merriam-webster.com/dictionary/receive, Merriam-Webster, Date accessed:Jan. 28, 2015.*

* cited by examiner

DETAIL B
SCALE 1 : 8

DETAIL B
SCALE 1 : 4

SECTION A-A
SCALE 2 : 1

INSULATED PALLET SHIPPER AND METHODS OF MAKING AND USING THE SAME

CROSS-REFERENCE TO RELATED APPLICATIONS

This application claims the benefit under of 35 U.S.C. 119(e) of U.S. Provisional Patent Application No. 60/993,419, filed Sep. 11, 2007, and U.S. Provisional Patent Application No. 61/188,565, filed Aug. 11, 2008, both of which are incorporated herein by reference.

BACKGROUND OF THE INVENTION

The present invention relates generally to insulated shipping containers and relates more particularly to insulated pallet shipping containers.

Insulated shipping containers of the type used to transport temperature sensitive materials, such as biological and/or pharmaceutical products, are well-known. Examples of such containers include U.S. Pat. No. 5,897,017, inventor Lantz, which issued Apr. 27, 1999; U.S. Pat. No. 6,257,764, inventor Lantz, which issued Jul. 10, 2001; U.S. Pat. No. 5,924,302, inventor Derifield, which issued Jul. 20, 1999; and U.S. Pat. No. 6,868,982, inventor Gordon, which issued Mar. 22, 2005, all of which are incorporated herein by reference.

Of the above patents, U.S. Pat. No. 6,868,982 is illustrative, this patent disclosing an insulated shipping container and a method of making the same. In a preferred embodiment, the insulated shipping container comprises an outer box, an insulated insert, an inner box and a closure member. The outer box, which is preferably made of corrugated fiberboard, comprises a rectangular prismatic cavity bounded by a plurality of rectangular side walls, a closed bottom end, and top closure flaps. The insulated insert is snugly, but removably, disposed within the outer box and is shaped to define a rectangular prismatic cavity bounded by a bottom wall and a plurality of rectangular side walls, the insulated insert having an open top end. The insulated insert is made of a foamed polyurethane body to which on all sides, except its bottom, a thin, flexible, unfoamed polymer bag is integrally bonded. The bag is a unitary structure having a generally uniform rectangular shape, the bag being formed by sealing shut one end of a tubular member with a transverse seam and forming longitudinal creases extending from opposite ends of the seam. The inner box, which is snugly, but removably, disposed within the insert, is preferably made of corrugated fiberboard and is shaped to include a rectangular prismatic cavity bounded by a plurality of rectangular side walls and a closed bottom end, the top end thereof being open. The closure member is a thick piece of foam material snugly, but removably, disposed in the open end of the inner box.

Although the shipping containers described above are suitable for many purposes, these containers are not particularly well-suited for transporting large payloads, such as pallet-sized payloads. As a result, other types of insulated shipping containers have been designed to transport larger payloads. Examples of such containers include U.S. Pat. No. 5,669,233, inventors Cook et al., which issued Sep. 23, 1997; U.S. Pat. No. 5,791,150, inventors Bosher et al., which issued Aug. 11, 1998; U.S. Pat. No. 6,266,972, inventor Bostic, which issued Jul. 31, 2001; U.S. Pat. No. 7,028,504, inventor Derifield, which issued Apr. 18, 2006; and U.S. Pat. No. 7,225,632, inventor Derifield, which issued Jun. 5, 2007, all of which are incorporated herein by reference.

Notwithstanding the above, there currently exists a need for an insulated shipping container that is capable of accommodating a larger payload, such as a pallet-sized payload, and that is capable of maintaining the payload within a desired temperature range, e.g., between 2° C. and 8° C. while being subjected to summer-like and/or winter-like ambient temperatures, for an extended period of time, e.g., up to several days or longer.

SUMMARY OF THE INVENTION

It is an object of the present invention to provide a novel insulated pallet shipper.

It is another object of the present invention to provide an insulated pallet shipper as described above that addresses at least some of the shortcomings associated with existing insulated pallet shippers.

It is still another object of the present invention to provide a method of making an insulated pallet shipper of the type described above.

According to one aspect of the invention, there is provided an insulated pallet shipper, the insulated pallet shipper comprising (a) an insulated container shaped to include a bottom wall, a top wall, a left side wall, a right side wall, a rear wall and a front wall, the walls collectively defining a cavity; and (b) a plurality of coolant members positioned within the cavity, each of the coolant members including a plurality of coolant bricks encased within a cardboard container.

According to another aspect of the invention, there is provided an insulated pallet shipper for transporting a payload, the insulated pallet shipper comprising: (a) an insulated container shaped to include a bottom wall, a top wall, a left side wall, a right side wall, a rear wall, and a front wall, the walls collectively defining a cavity; (b) a coolant tray, the coolant tray being disposed within the cavity and spaced above the payload; and (c) a plurality of coolant members positioned within the cavity, each of the coolant members including a plurality of coolant bricks encased within a cardboard container, at least some of the coolant members lying on top of the bottom wall below the payload, at least some of the coolant members being positioned along the interior of the left side wall and the interior of the right side wall, and at least some of the coolant members lying on top of the coolant tray.

For purposes of the present specification and claims, relational terms like "top," "bottom," "upper," "lower," "front," and "rear," are used to describe the present invention in a given orientation. It is to be understood that, by orienting the shipper in a different direction, the directionality of the invention will need to be adjusted accordingly.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate an embodiment of the invention and, together with the description, serve to explain the principles of the invention. In the drawings wherein like reference numerals represent like parts:

FIG. 8(*c*) is a plan view, broken away in part, of one of the coolant members shown in FIG. 1;

FIG. 8(*d*) is a plan view, broken away in part, of one of the coolant bricks shown in the coolant member of FIG. 8(*c*)

DETAILED DESCRIPTION OF PREFERRED EMBODIMENTS

Figure 1:
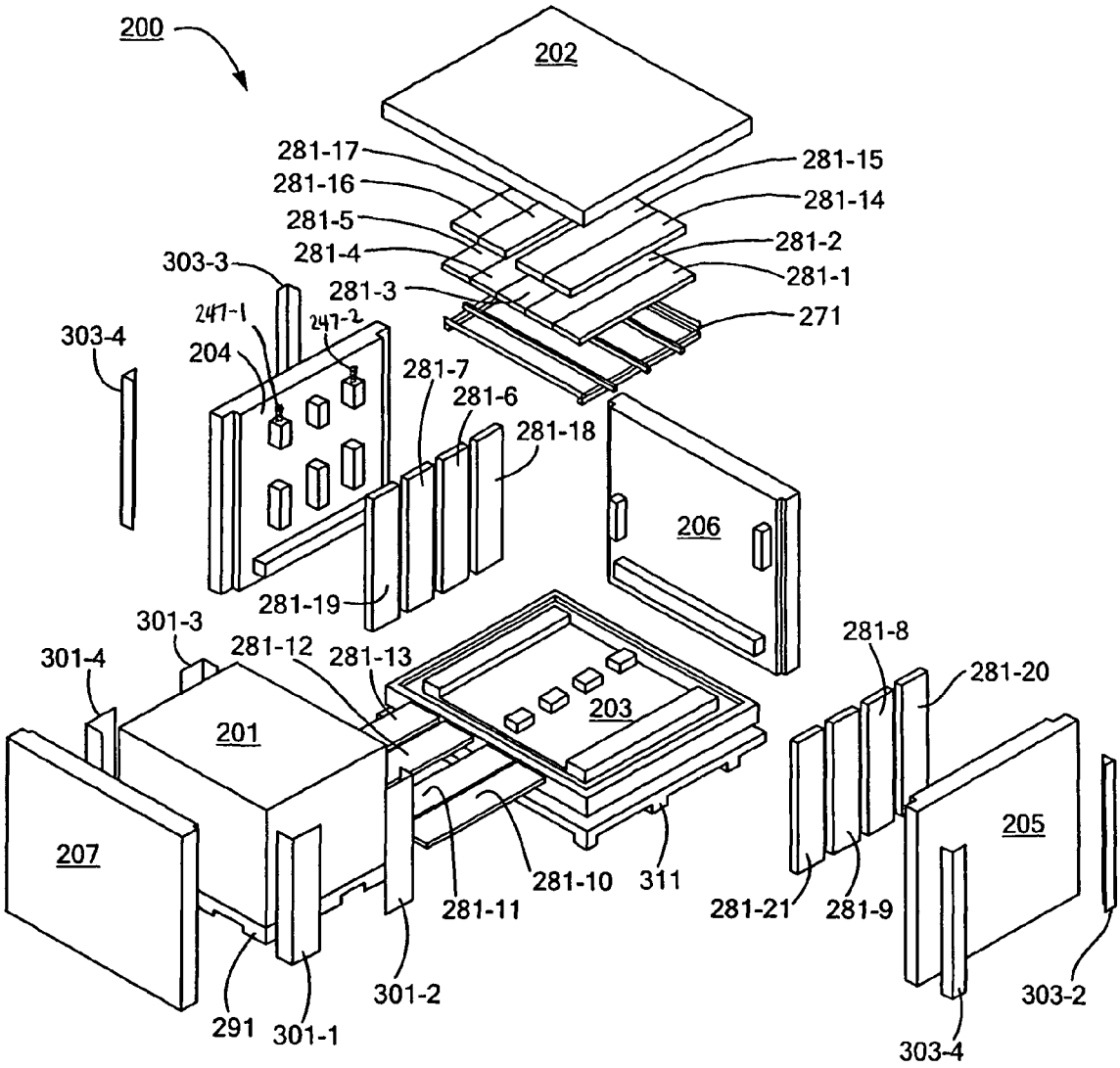
FIG. 1 is an exploded perspective view of one embodiment of an insulated pallet shipper constructed according to the teachings of the present invention, the insulated pallet shipper being shown with a payload.
Figure 2:
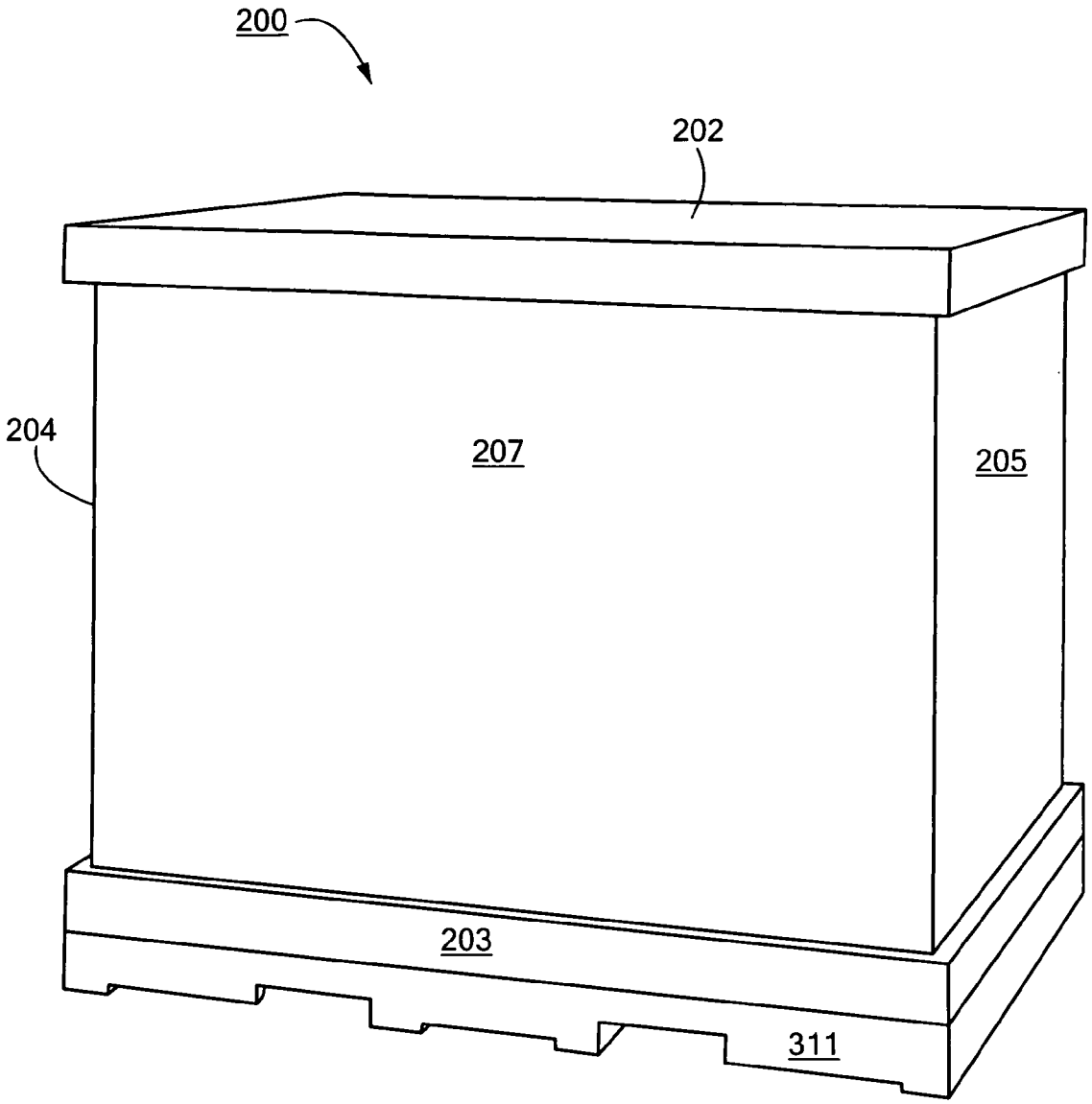
FIG. 2 is a perspective view of the insulated pallet shipper of FIG. 1 in an assembled state, with the exterior corner braces not being shown.
Figure 3A:
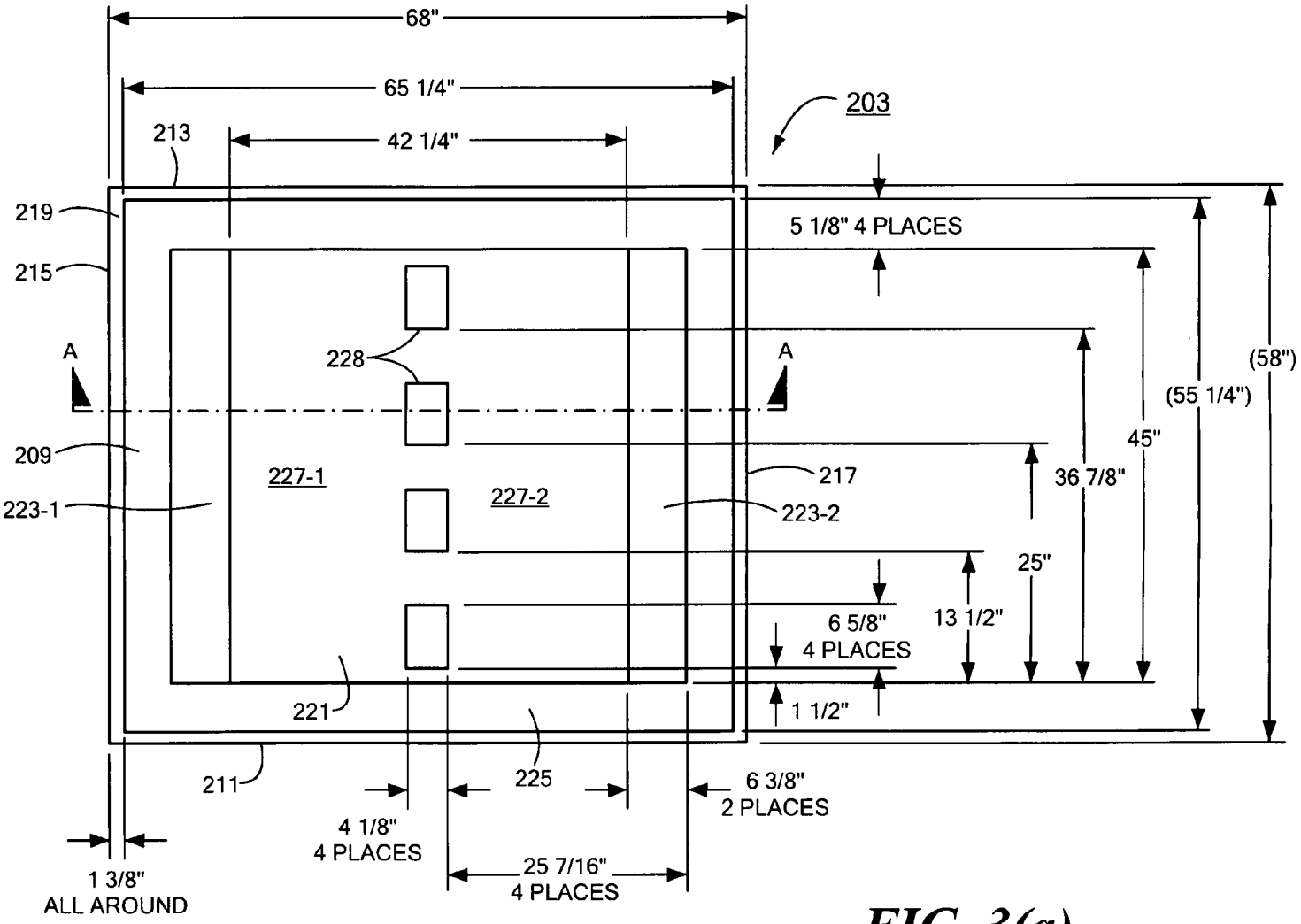
FIGS. 3(*a*) through 3(*d*) are top, section, enlarged section, and perspective views, respectively, of the bottom wall shown in FIG. 1.
Figure 3B:
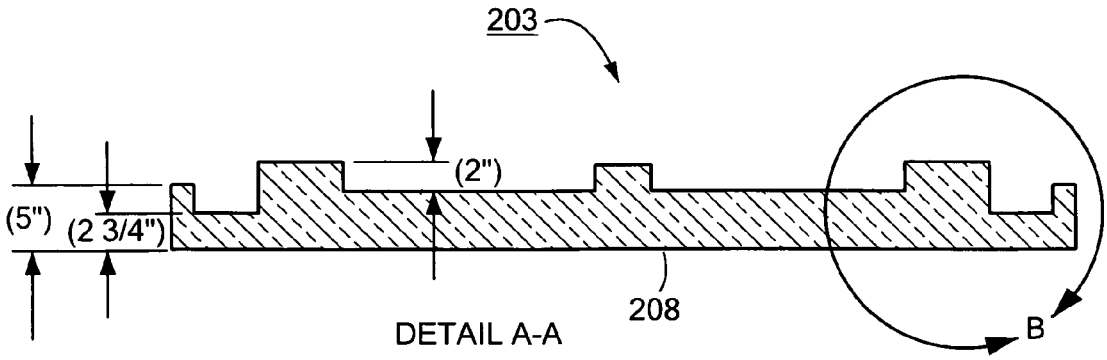
Figure 3C:
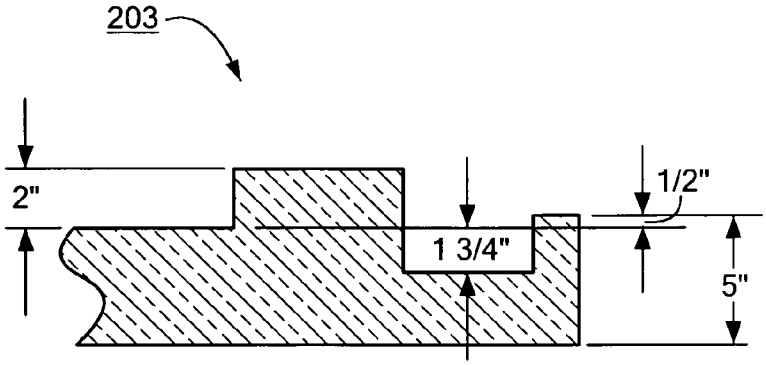
Figure 3D:
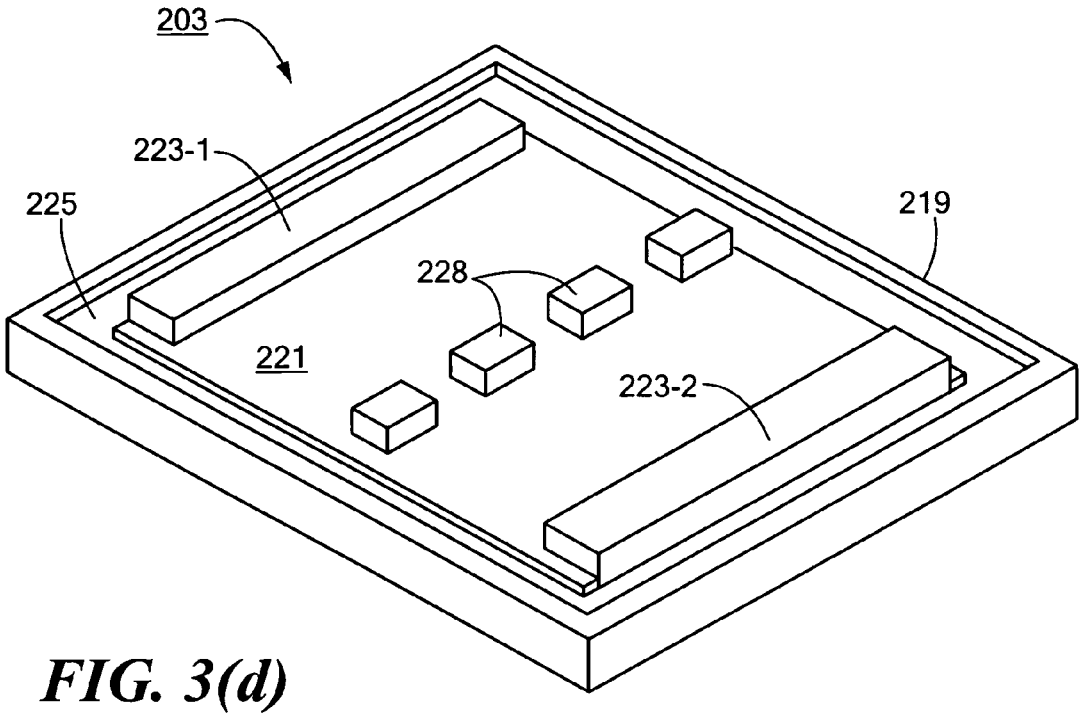

Referring now to FIGS. 1 and 2, there are shown exploded perspective and perspective views, respectively, of one embodiment of an insulated pallet shipper constructed according to the teachings of the present invention, said insulated pallet shipper being represented generally by reference numeral 200. A payload 201 is shown together with shipper 200 in FIG. 1.

Shipper 200 may include a top wall 202, a bottom wall 203, a left side wall 204, a right side wall 205, a rear wall 206 and a front wall 207. Top wall 202 and bottom wall 203 may be identical to one another in size, shape and construction, left side wall 204 and right side wall 205 may be identical to one another in size, shape and construction, and rear wall 206 and front wall 207 may be identical to one another in size, shape and construction.

Bottom wall 203, which is shown separately in FIGS. 3(*a*) through 3(*d*), may be a generally rectangularly-shaped structure shaped to include a flat bottom 208, a top 209, a flat front 211, a flat rear 213, a flat left side 215 and a flat right side 217. Top 209 may be shaped to include an upwardly-extending peripheral lip 219 and a plurality of upwardly-extending blocks 221, 223-1 and 223-2. Lip 219 and blocks 221, 223-1 and 223-2 together may define a continuous interior groove 225, groove 225 being adapted to snugly receive the bottom ends of left side wall 204, right side wall 205, rear wall 206, and front wall 207, respectively. Block 221 may be effectively bisected along its top surface into a left portion 227-1 and a right portion 227-2 by a plurality of upwardly-extending projections 228. As will be discussed further below, left portion 227-1 may be dimensioned so that two coolant members, each oriented parallel to block 223-1, may be securely received between projections 228 and block 223-1, and right portion 227-2 may be dimensioned so that an additional two coolant members, each oriented parallel to block 223-2, may be securely received between projections 228 and block 223-2. In addition, blocks 223-1 and 223-2 and projections 228 may be sufficiently great in height so that a shipping pallet may be supported thereon while clearing the coolant members positioned in left portion 227-1 and right portion 227-2.

Figure 4:
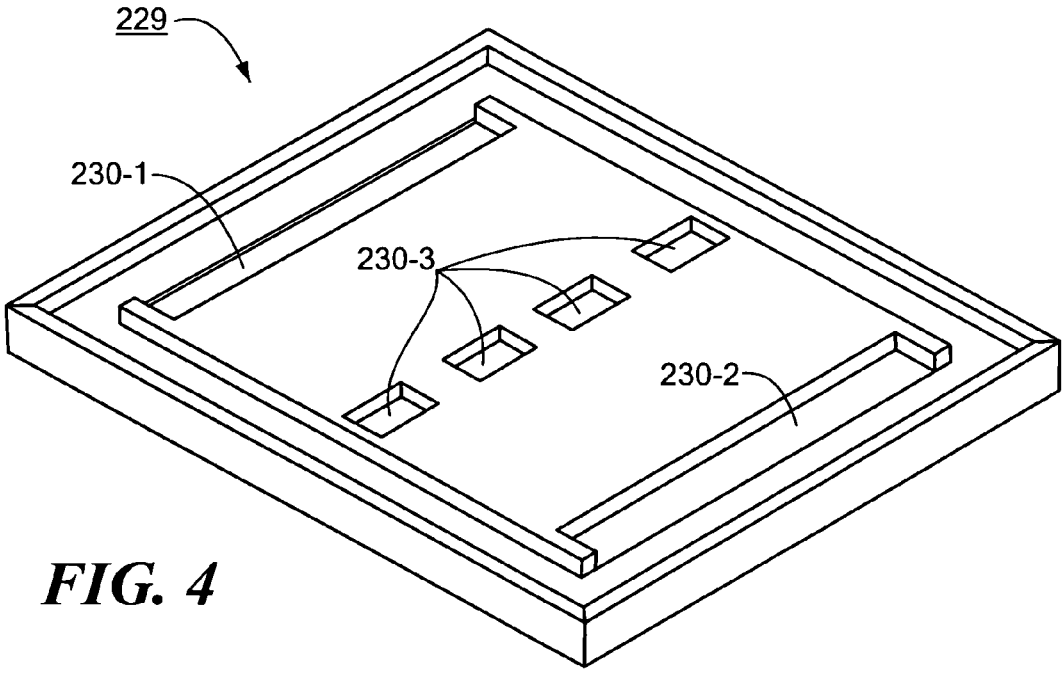
FIG. 4 is an enlarged perspective view of a corrugated cardboard material with cut-outs that may be used to form the bottom wall of FIGS. 3(*a*) through 3(*d*)
Figure 5A:
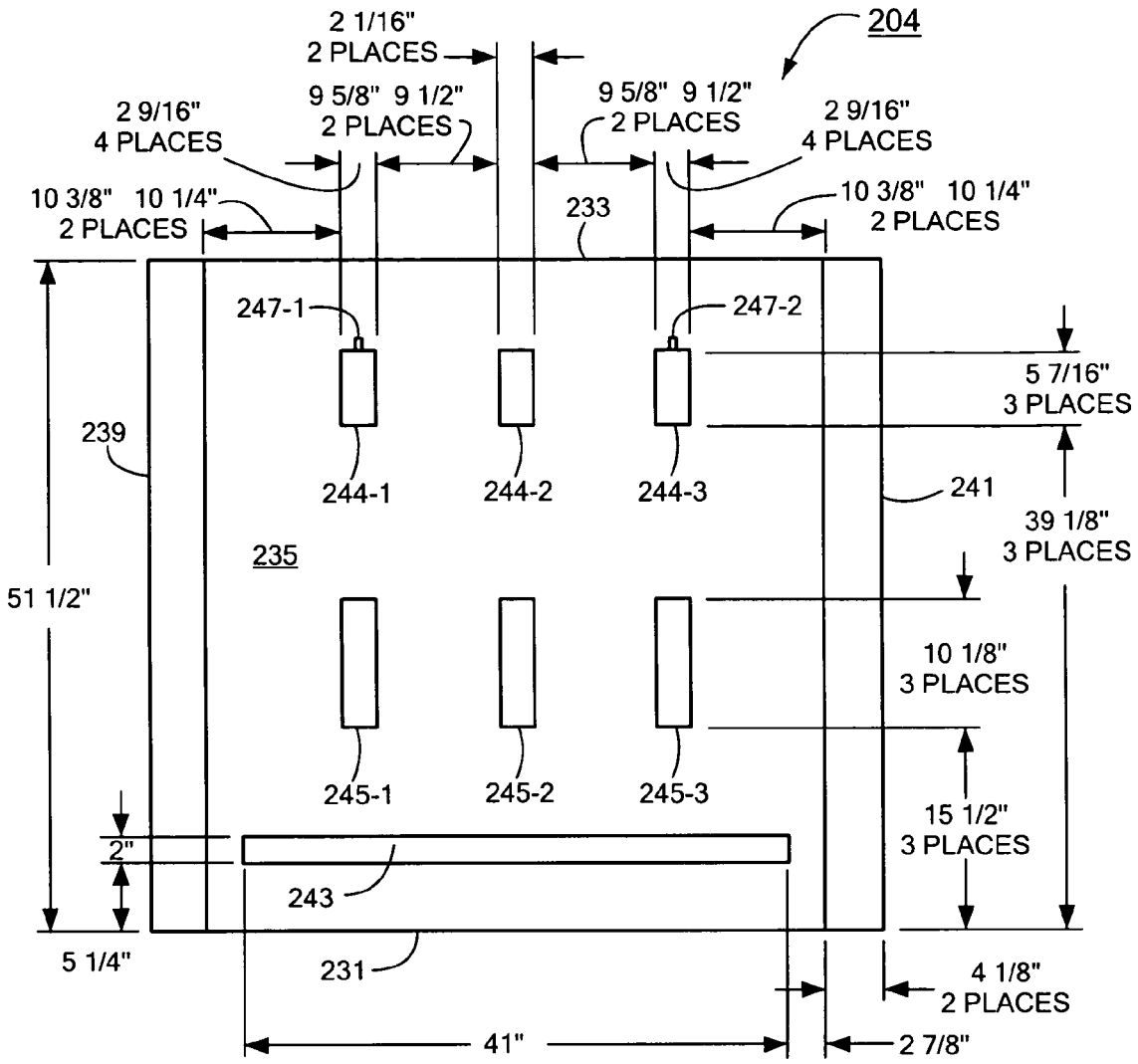
FIGS. 5(*a*) through 5(*e*) are side, top, front, enlarged top, and enlarged front views, respectively, of the left side wall shown in FIG. 1.
Figure 5B:
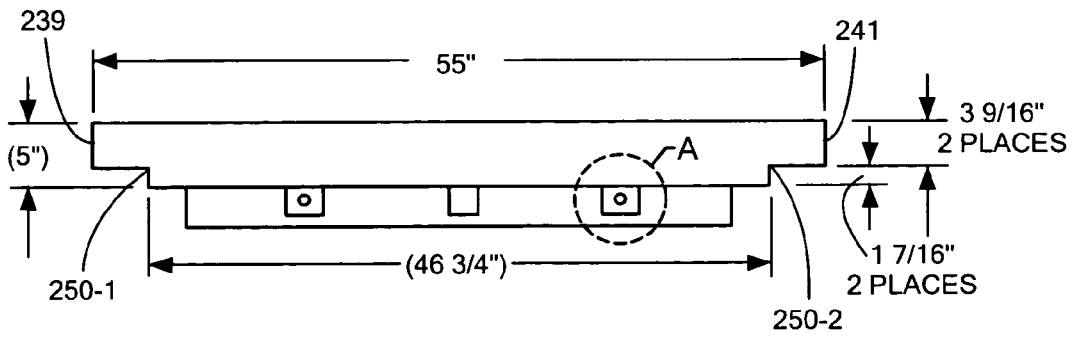
Figure 5C:
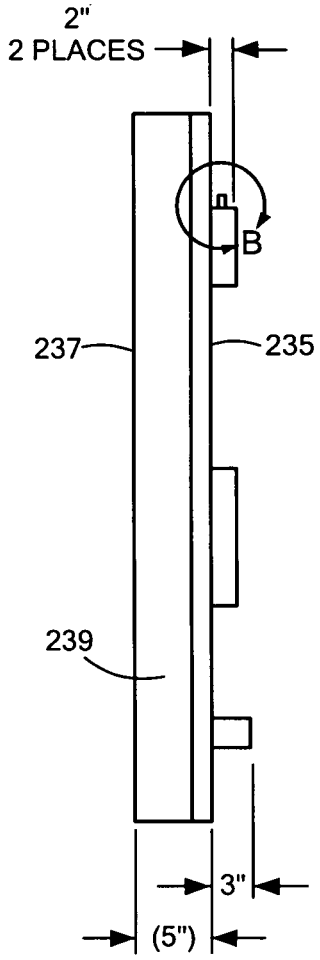
Figure 5D:
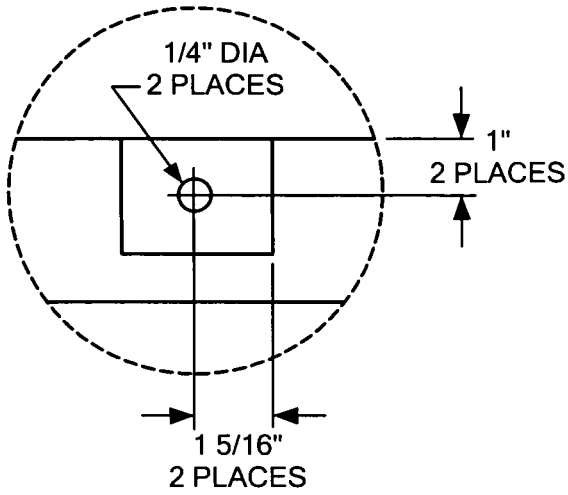
Figure 5E:
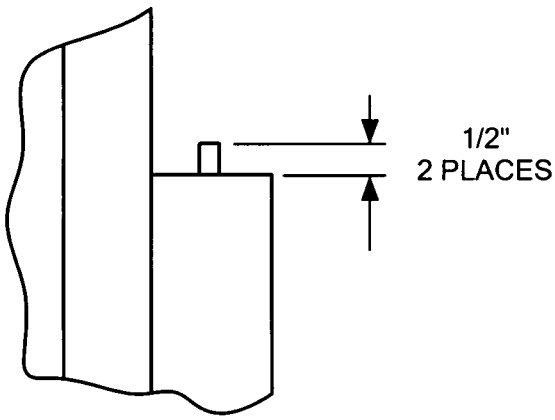

In terms of its composition, bottom wall 203 may be made in a manner generally similar to that used to make insert 31 of U.S. Pat. No. 6,868,982 and, therefore, may comprise a body of insulating material and a thin, flexible, non-self-supporting, polymer bag. The insulating material may comprise a body of foamed polymer material, preferably a foamed polyurethane. Blowing agents may be used to form said foamed polyurethane, such blowing agents including, for example, hydrofluorocarbons (HFC), such as HFC-134a or HFC-245, as well as carbon dioxide, methyl formate, cyclopentanes, and hydrochlorofluorocarbons (HCFC). The unfoamed polymer bag may be made, of hexene or a polyethylene, preferably a high density polyethylene, and may be integrally bonded and conformal to the foamed body, with the bag covering much of the outer surface of the foamed body, excluding the bottom surface of the body. However, more preferably, bottom wall 203 may be formed by replacing the aforementioned unfoamed polymer bag with a combination of one or more sheets of corrugated cardboard material and a plurality of pre-fabricated thermoformed pieces. More specifically, the corrugated cardboard material may be provided with a plurality of transverse openings or cut-outs (see FIG. 4 for a cardboard sheet 229 having openings 230-1, 230-2 and 230-3), with the pre-fabricated thermoformed pieces fixedly mounted in the cut-outs and shaped to define blocks 223-1 and 223-2 and projections 228. The cardboard material and thermoformed pieces may be introduced into the mold used to form the foamed body so that the foamed body fills the inwardly-facing cavities of the thermoformed pieces, as well as defining the remainder of the foamed body. An additional sheet of corrugated cardboard material or the like may be used to cover the exposed bottom surface of the foamed body, the sheets of corrugated cardboard material being taped or otherwise fixedly secured to one another.

Left side wall 204, which is shown separately in FIGS. 5(*a*) through 5(*e*), may be a generally rectangularly-shaped member that may include a flat bottom 231, a flat top 233, a front 235, a flat rear 237, a left side 239 and a right side 241. Bottom 231 may be appropriately shaped to fit securely within a corresponding portion of groove 225 of bottom wall 203. Front 235 may be shaped to securely receive a plurality of coolant members. For example, front 235 may include a horizontally-extending projection 243 and two sets of vertically-extending projections 244-1 through 244-3 and 245-1 through 245-3. Projection 243 may be appropriately dimensioned so that a plurality of coolant members may rest thereupon, with projections 244-1 through 244-3 and 245-1 through 245-3 being arranged to separate adjacent coolant members. Preferably, the spacing between adjacent projections 244-1 through 244-3 and between adjacent projections 245-1 through 245-3 is such that the coolant members securely fit within such spaces, with any air spaces between adjacent projections 244-1 through 244-3 and between adjacent projections 245-1 through 245-3 being minimized. In addition, projections 244-1 through 244-3 and 245-1 through 245-1 are preferably dimensioned so that their respective heights are less than that of the coolant members, i.e., the coolant members extend more deeply into the cavity of the container than do projections 244-1 through 244-3 and 245-1 through 245-3.

A pin 247-1 is fixedly mounted in projection 244-1 and extends upwardly a short distance therefrom, and a pin 247-2 is fixedly mounted in projection 244-3 and extends upwardly a short distance therefrom. As will be seen below, pins 247-1 and 247-2 are used to mount a coolant tray.

Left side wall 204, like bottom wall 203, may comprise a body of foamed polymer material covered with a corrugated cardboard material or the like. Also, in a fashion similar to that in bottom wall 203, projections 243, projections 244-1 through 244-3, and projections 245-1 through 245-3 may be formed using pre-fabricated thermoformed pieces mounted within cut-outs provided in the corrugated cardboard material.

Figure 6A:
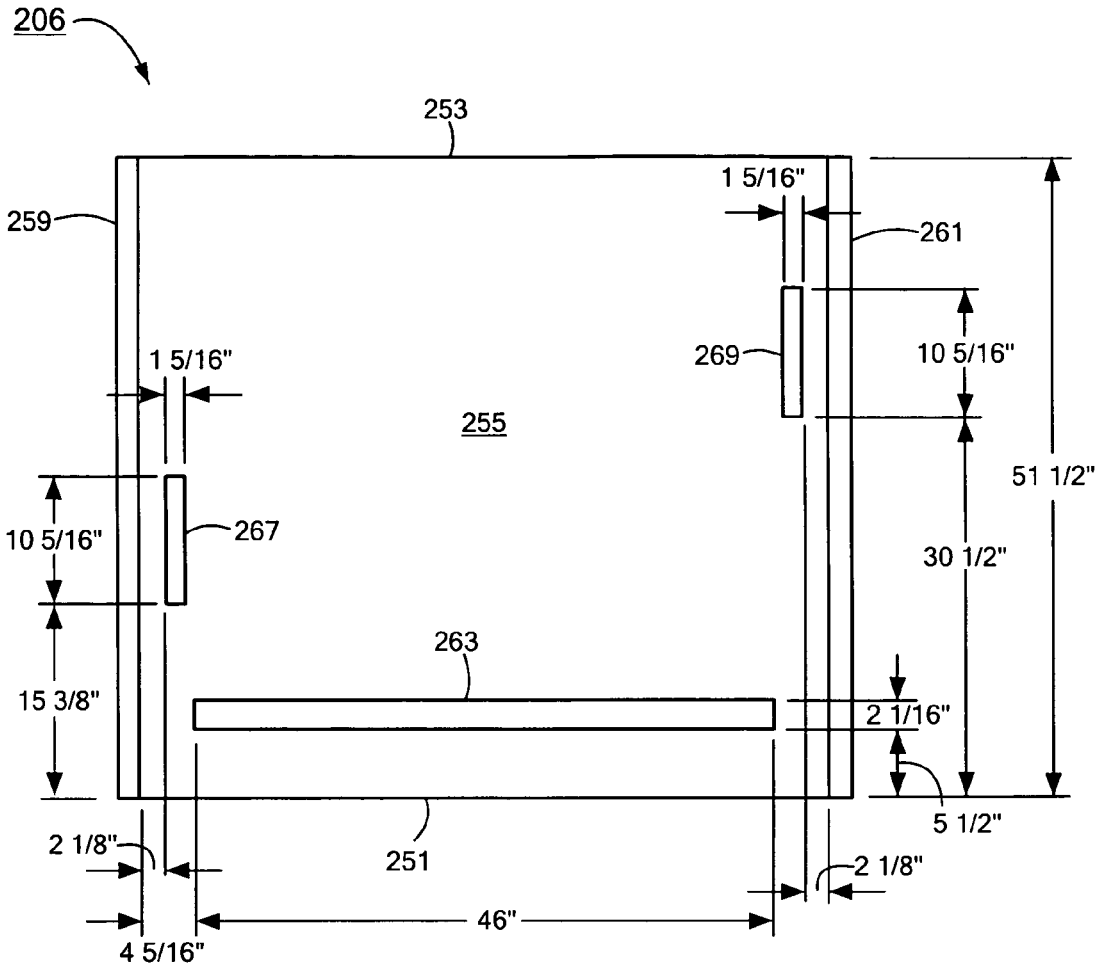
FIGS. 6(*a*) through 6(*c*) are front, top and side views, respectively, of the rear wall shown in FIG. 1.
Figure 6B:
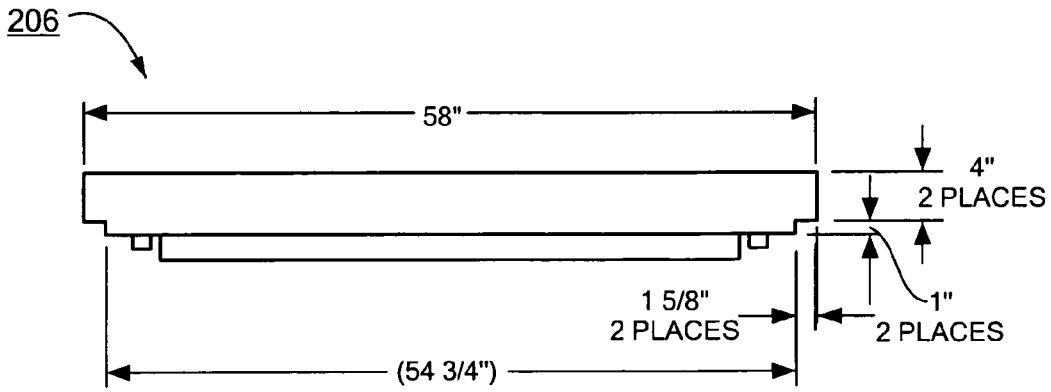
Figure 7B:
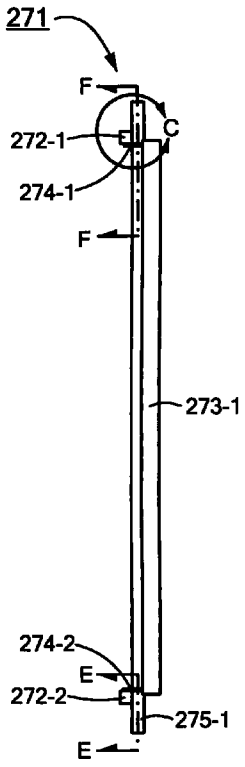
FIGS. 7(*a*) through 7(*h*) are various views of the coolant rack shown in FIG. 1.
Figure 7A:
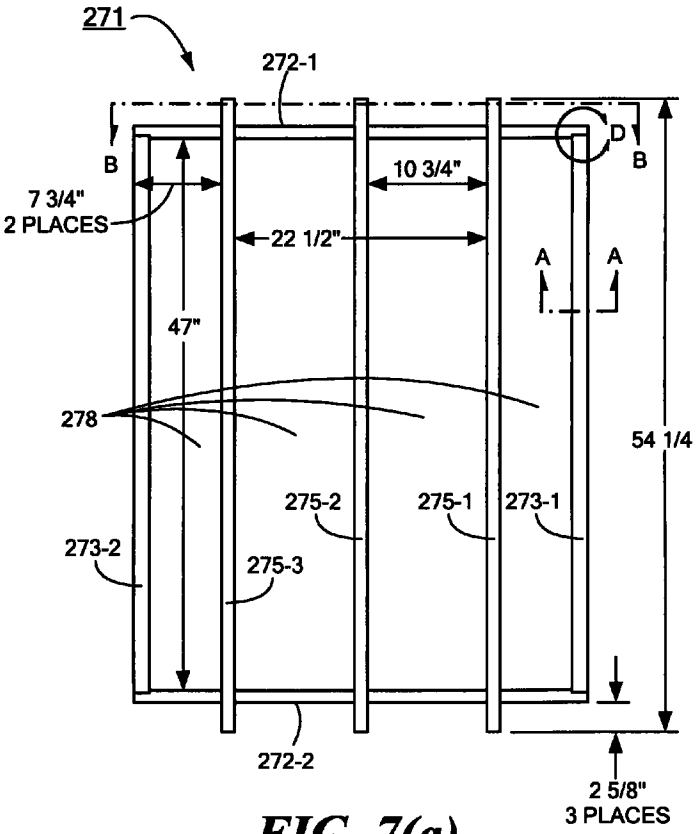
Figure 6C:
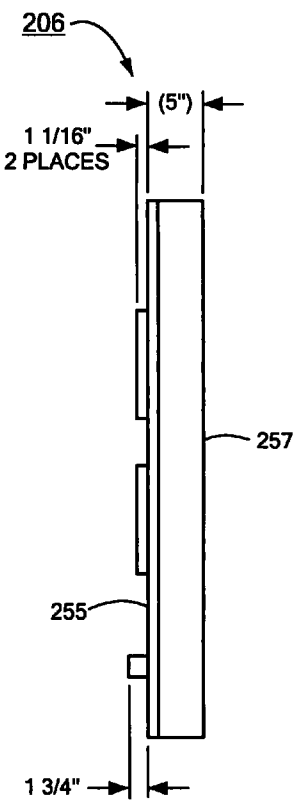
Figure 7C:
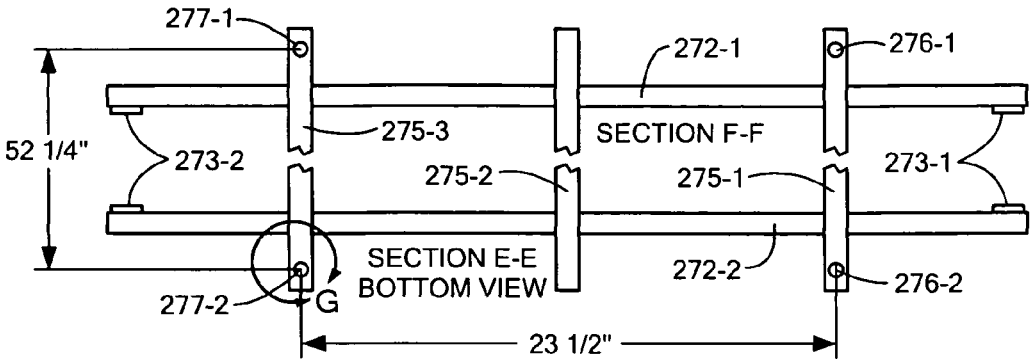
Figure 7D:
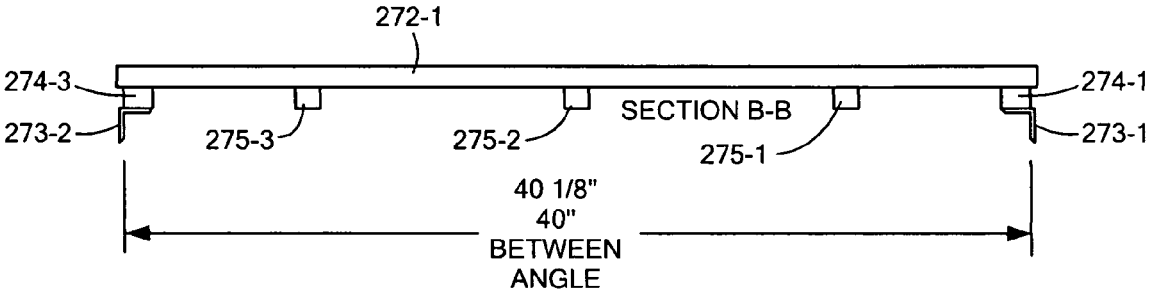
Figure 7E:
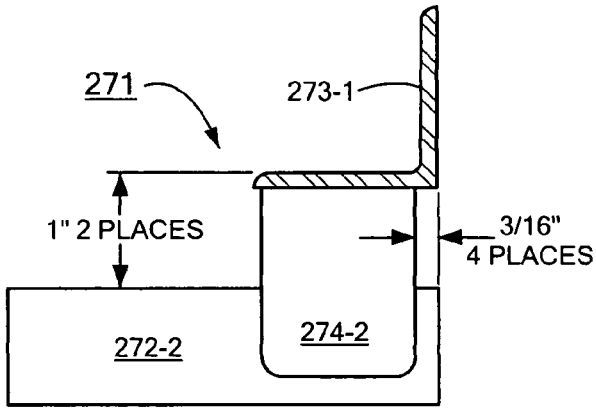
Figure 7F:
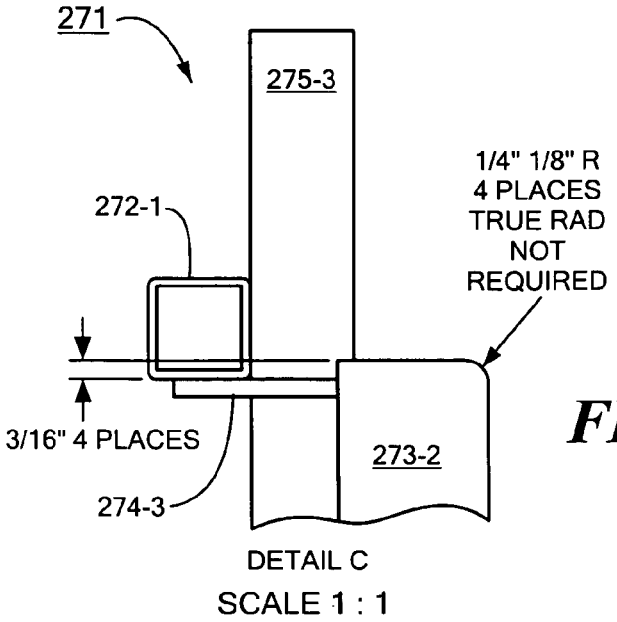
Figure 7G:
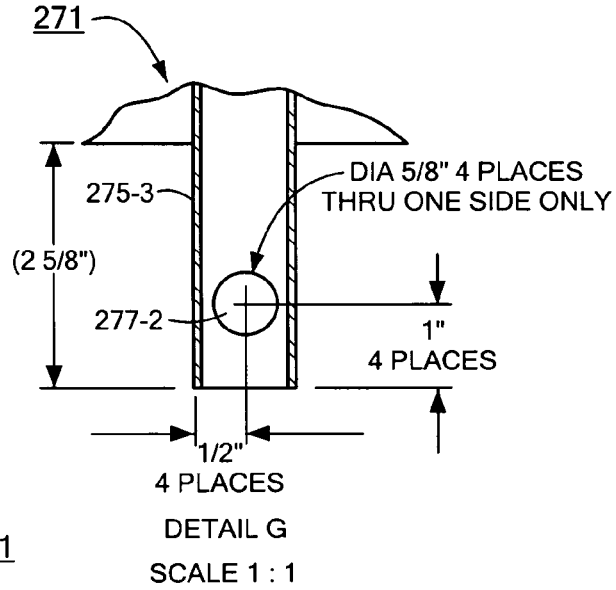
Figure 7H:
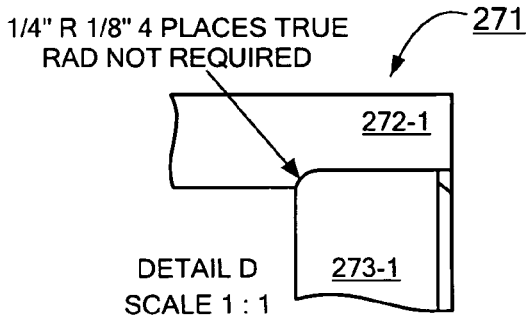
Figure 8A:
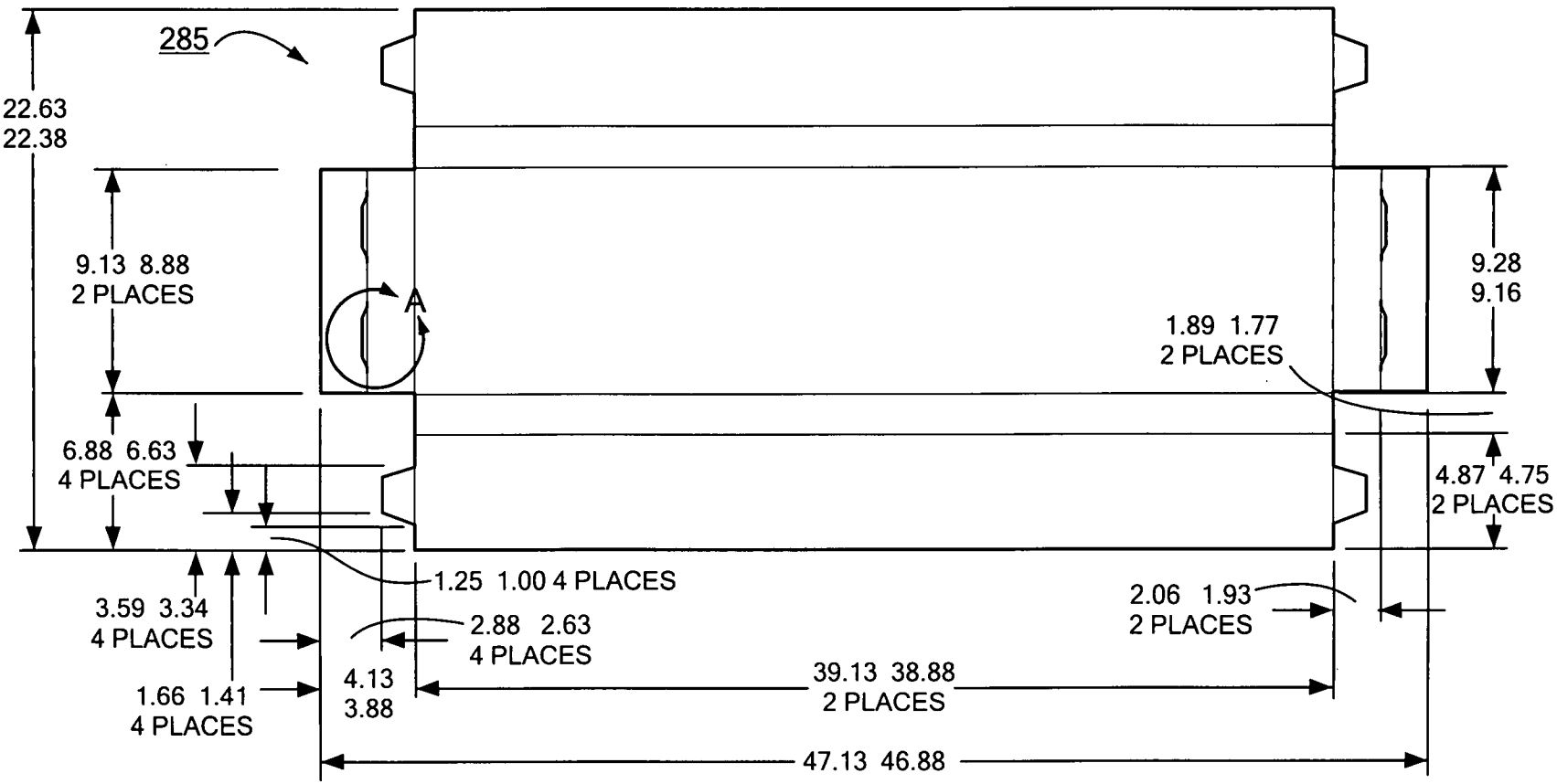
FIGS. 8(*a*) and 8(*b*) are plan and enlarged views, respectively, of the sheet used in the refrigerant sleeve shown in FIG. 1.
Figure 8B:
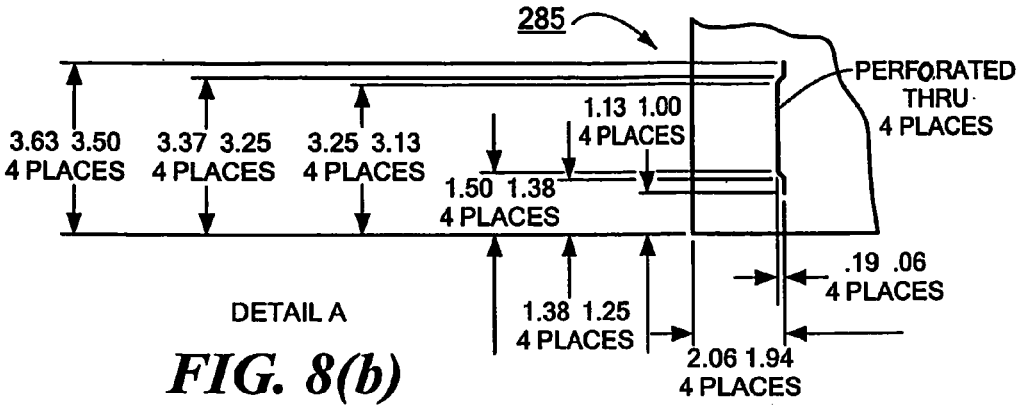
Figure 9A:
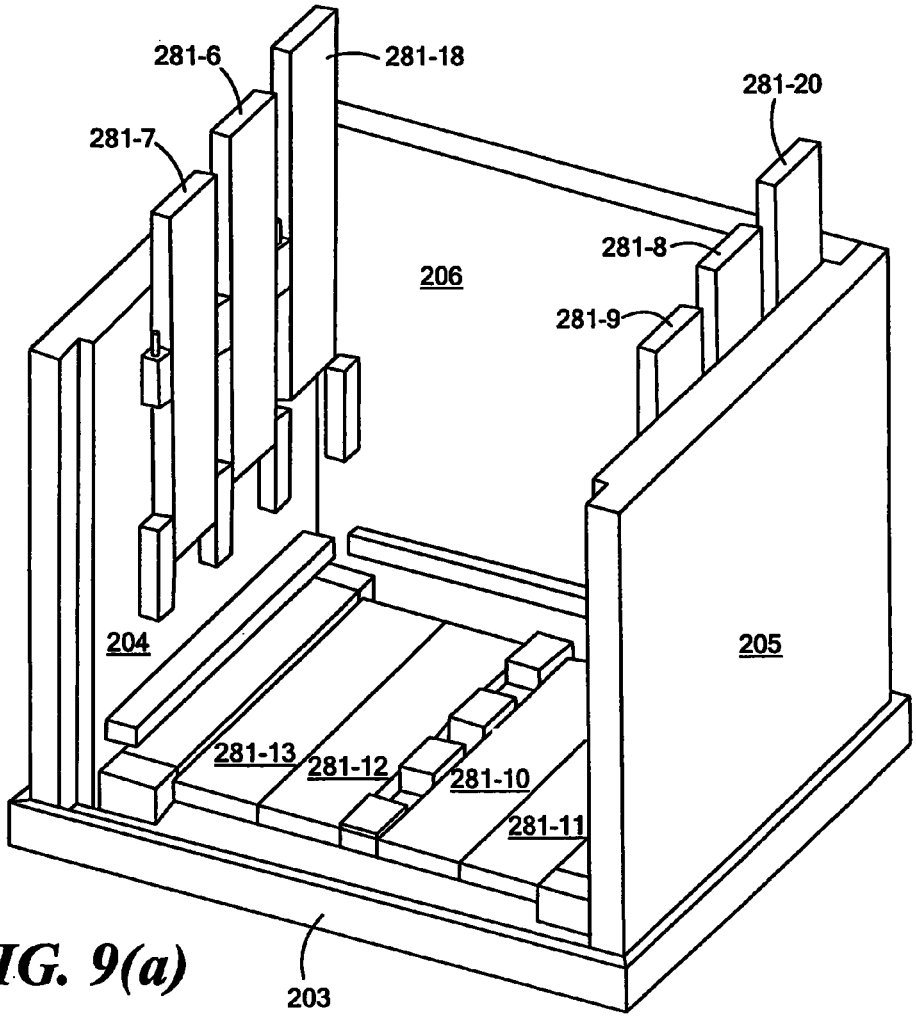
FIGS. 9(*a*) through 9(*d*) are various views illustrating the manner in which the insulated pallet shipper of FIG. 1 may be used.
Figure 8C:
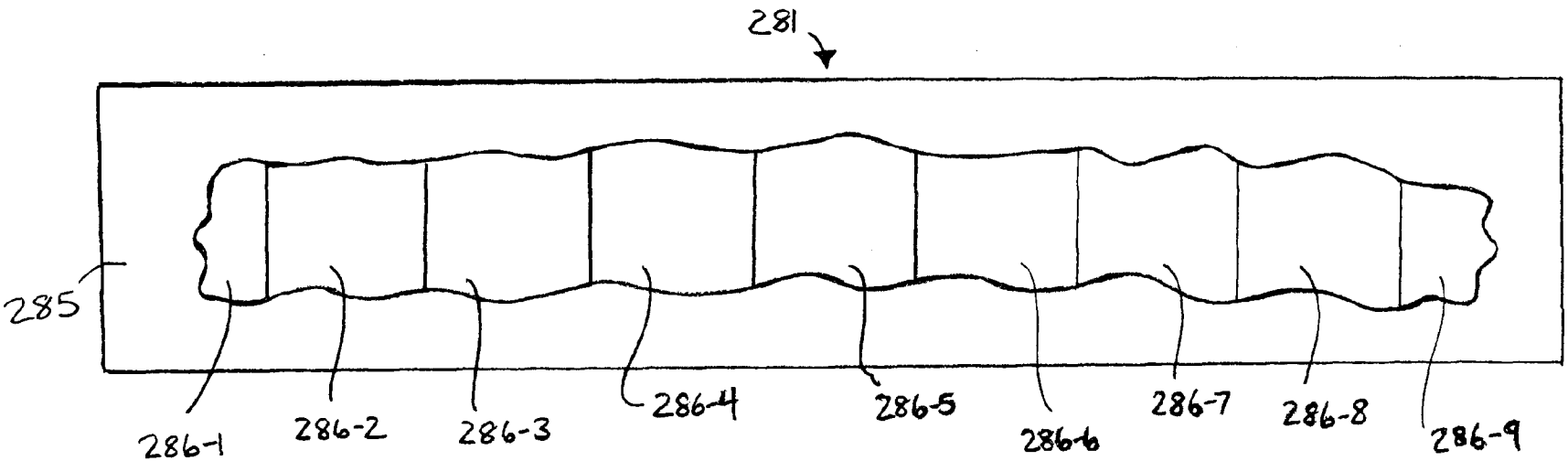
Figure 8D:
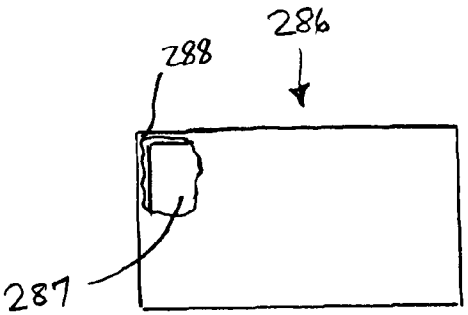
Figure 9B:
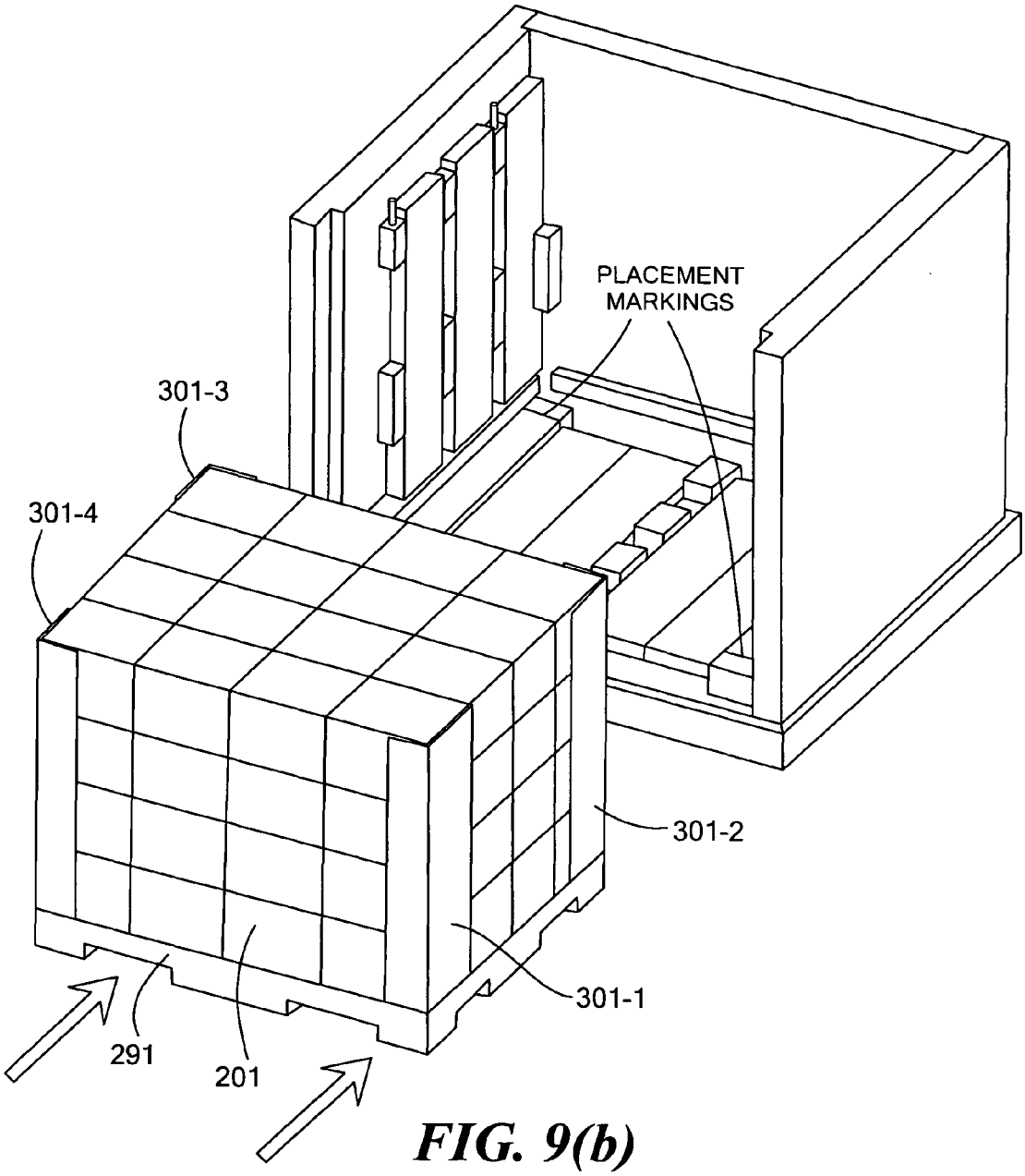
Figure 9C:
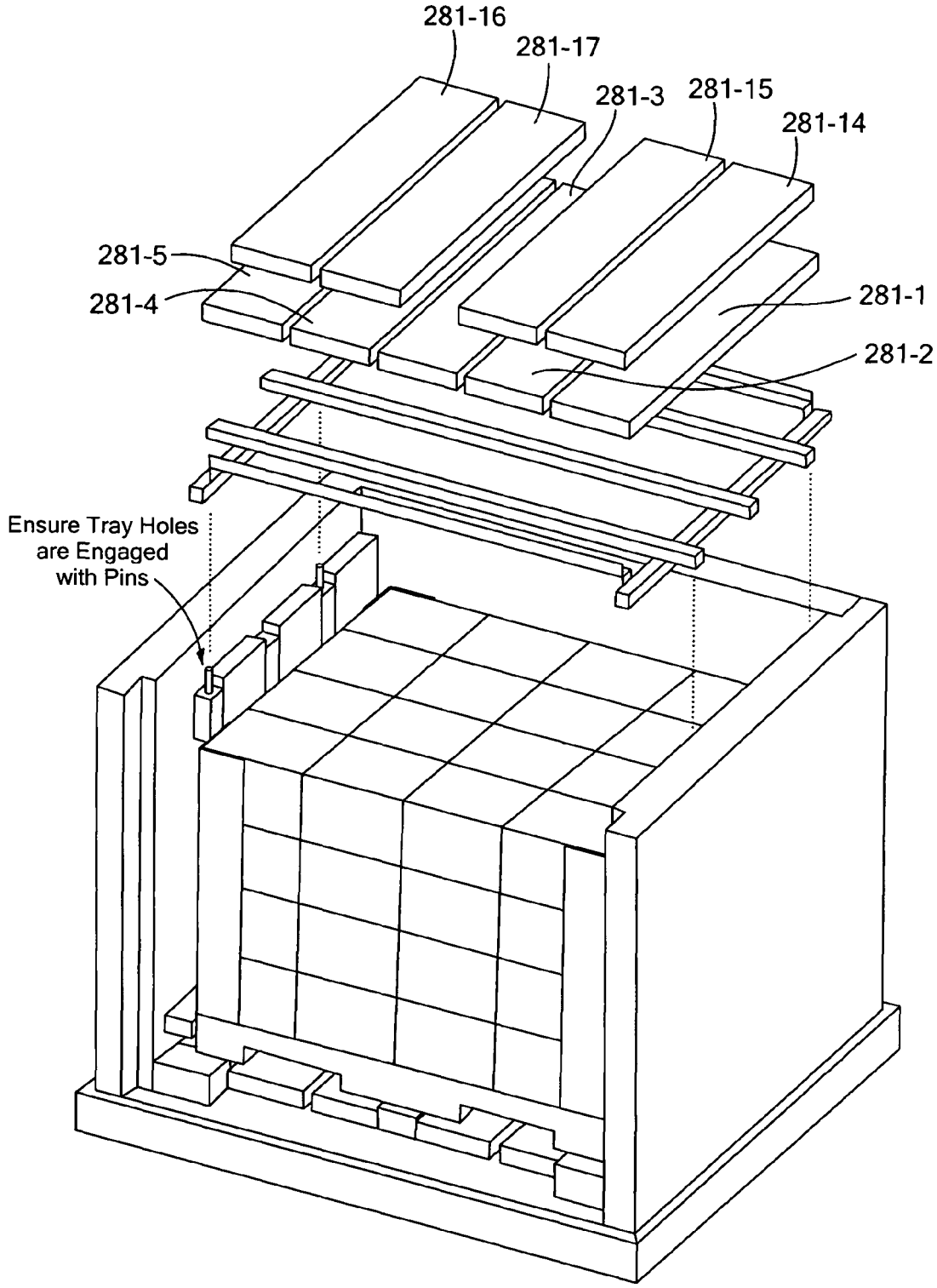
Figure 9D:
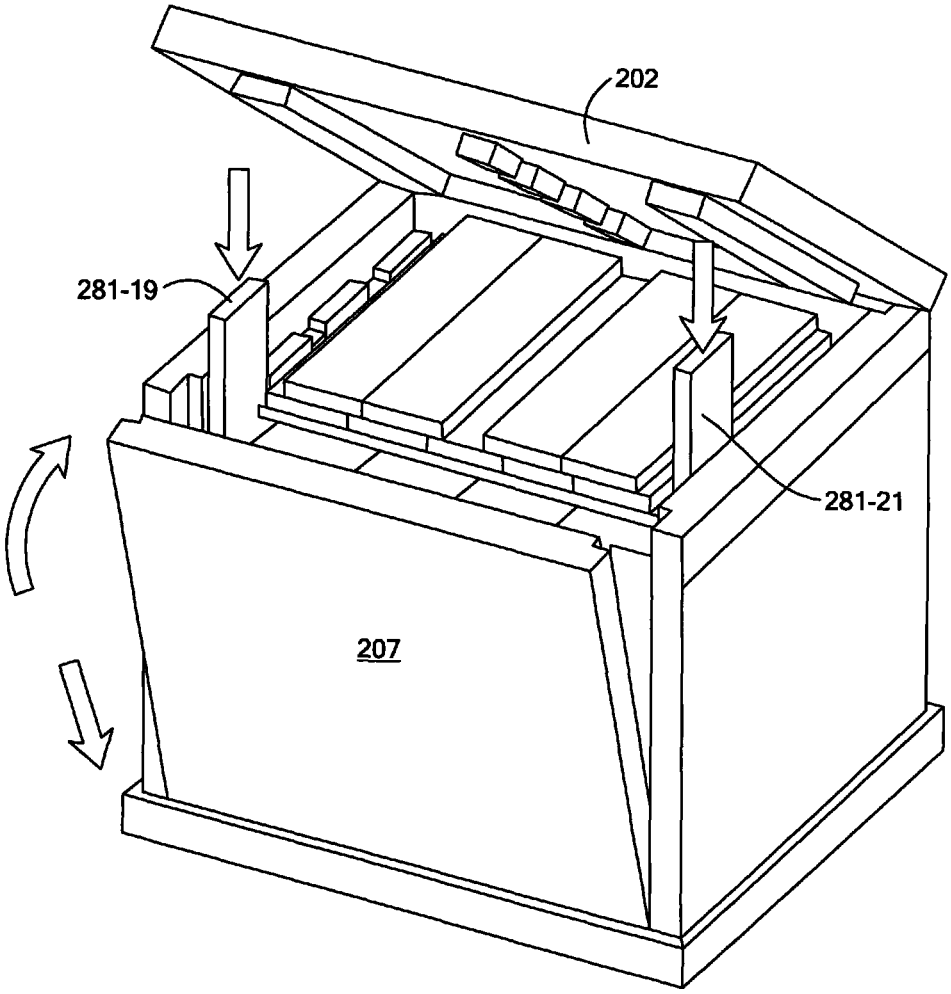

Rear wall 206, which is shown separately in FIGS. 6(*a*) through 6(*c*), may be a generally rectangularly-shaped member that may include a flat bottom 251, a flat top 253, a front 255, a flat rear 257, a left side 259 and a right side 261. Bottom 251 may be appropriately shaped to fit securely within a corresponding portion of groove 225 of bottom wall 203. Front 255 may be shaped to include a lower horizontal projection 263, a left vertical projection 267, and a right vertical projection 269. Projection 263 may be appropriately positioned and dimensioned to serve as a stop to delimit the insertion of a pallet into the interior of the container cavity. Left vertical projection 267 may be positioned and dimensioned to act in conjunction with projections 244-3 and 245-3 of left side wall 204 to securely retain a coolant member therebetween. Similarly, right vertical projection 269 may be positioned and dimensioned to act in conjunction with projections 244-1 and 245-1 of right side wall 205 to securely retain a coolant member therebetween.

Rear wall 206, like bottom wall 203, may comprise a body of foamed polymer material covered with a corrugated cardboard material or the like. Also, in a fashion similar to that in bottom wall 203, projections 263, 267 and 269 may be formed using pre-fabricated thermoformed pieces mounted within cut-outs provided in the corrugated cardboard material.

As can be seen, the right and left sides of each of left side wall 204, right side wall 205, rear wall 206 and front wall 207 may be stepped so that the walls fit together in a complementary fashion when the walls are inserted into groove 225. Although not shown, a strip of foam or like weatherstripping material may be applied to steps 250-1 and 250-2 of left side wall 204 (as well as to the corresponding steps of right side wall 205) to act as a seal between the mating wall pieces.

Shipper 200 may further comprise a coolant rack 271, which is shown separately in FIGS. 7(*a*) through 7(*h*). Rack 271 may comprise a pair of bars 272-1 and 272-2 spaced apart from and oriented parallel to one another. Bars 272-1 and 272-2 may be made of a strong, rigid polymer or metal and may be hollow and generally rectangular in transverse cross-section. A first L-shaped bracket 273-1, which may be made of a strong, rigid polymer or metal, may be attached at one end by a connecting strip 274-1 to the front end of bar 272-1 and may be attached at the opposite end by a connecting strip 274-2 to the front end of bar 272-2. A second L-shaped bracket 273-2, which may be made of a strong, rigid polymer or metal, may be attached at one end by a connecting strip 274-3 to the rear end of bar 272-1 and may be attached at the opposite end by a connecting strip 274-4 to the rear end of bar 272-2. As can be seen best in FIG. 7(*d*), brackets 273-1 and 273-2 are oriented to face one another so that the ends of a coolant member may be seated on brackets 273-1 and 273-2 and extend therebetween. Rack 271 may further comprise a plurality of crossbars 275-1 through 275-3. Crossbars 275-1 through 275-3, which may be made of a strong, rigid polymer or metal, may be hollow and generally rectangular in transverse cross-section. Crossbars 275-1 through 275-3 may be spaced apart from and oriented parallel to one another, with each of crossbars 275-1 through 275-3 being seated on top of and oriented generally perpendicularly to bars 272-1 and 272-2. Each of cross-bars 275-1 through 275-3 may be fixed at a point spaced inwardly from one end to bar 272-1 and may be fixed at a point spaced inwardly from the opposite end to bar 272-2. Cross-bar 275-1 may be provided with openings 276-1 and 276-2 on its bottom surface adapted to receive pins 247-1 and 247-2 on left side wall 204 and right side wall 205, respectively, and cross-bar 275-3 may be provided with openings 277-1 and 277-2 on its bottom surface adapted to receive pins 247-2 and 247-1 on left side wall 204 and right side wall 205, respectively. In this manner, rack 271 may be seated upon projections 244-1 through 244-3 of left side wall 204 and right side wall 205. A plurality of openings 278 are provided between adjacent cross-bars 275-1 through 275-3, between bracket 273-1 and cross-bar 275-1, and between bracket 273-2 and cross-bar 275-3, openings 278 permitting the passage of air cooled by coolant members seated upon rack 271 to the payload spaced below rack 271.

Shipper 200 may also comprise a plurality of coolant members 281-1 through 281-21. Coolant members 281-1 through 281-21 may be identical to one another in size, shape and composition, with the only difference amongst coolant members 281-1 though 281-20 being that certain coolant members, such as coolant members 281-1 through 281-13, are preconditioned, preferably for at least 24 hours, at a refrigerating temperature, such as 5° C.±3° C., and other coolant members, such as coolant members 281-14 through 281-21, are preconditioned, preferably for at least 24 hours, at a freezing temperature, such as −20° C.±3° C. Each coolant member 281 may comprise a plurality of (e.g., nine) identical coolant bricks, which bricks may be stacked within a closed-ended sleeve. (In FIGS. 8(*a*) and 8(*b*), a sleeve 285 for a coolant member 281 is shown. Sleeve 285 may be made of a corrugated cardboard or similar material. FIG. 8(*c*) shows a representative coolant member 281 comprising a plurality of identical coolant bricks 286-1 through 286-9 stacked within sleeve 285.) The coolant bricks may comprise a foam refrigerant block of hexahedron shape (e.g., 9"×4"×1.5") encased in a flexible metal foil. FIG. 8(*d*) shows a representative coolant brick 286 comprising a foam refrigerant block 287 encased within a flexible metal foil 288.

Shipper 200 may further comprise an inner pallet 291, upon which payload 201 may be seated. Pallet 291, which may be 48"×40" in size, is adapted to be removably inserted into the cavity of the container, for example, through the open front end of shipper 200. Inner pallet 291 may be supplied by the user of shipper 200.

Shipper 200 may further comprise a plurality of payload corner support braces 301-1 through 301-4 and a plurality of exterior corner support braces 303-1 through 303-4. Payload corner support braces 301-1 through 301-4, which may be made of foamboard or the like, may be used to brace the payload, which may be shrink-wrapped together with inner pallet 291. Exterior corner support braces 303-1 through 303-4 may be used to provide support to the exterior corners of the container, which may be secured with straps or the like.

Shipper 200 may further comprise an outer pallet 311. Pallet 311, which may be made of a polymer, wood, or another suitable material, is appropriately dimensioned so that the container and its contents may be seated thereupon.

Although shipper 200 may be varied in size to suit particular applications, illustrative dimensions for a preferred embodiment are shown in several of the drawings.

Shipper 200 may be reversibly assembled and disassembled a number of times. For example, shipper 200 may be stored or transported in an unassembled state and thereafter assembled for use. Following use, shipper 200 may be disassembled and thereafter stored or transported.

Referring now to FIGS. 9(*a*) through 9(*d*), there is shown one manner in which shipper 200 may be assembled and used. First, with bottom wall 203 seated upon an outer pallet (not shown), left side wall 204 and right side wall 205 may be inserted into groove 225 of bottom wall 203, and then rear wall 206 may be inserted into groove 225, with rear wall 206 mating with left side wall 204 and right side wall 205. Next, refrigerated coolant members 281-12 and 281-13 may be placed on left portion 227-1 of bottom wall 203, and refrigerated coolant members 281-10 and 281-11 may be placed on right portion 227-2 of bottom wall 203. Next, refrigerated coolant members 281-7 and 281-6 and frozen coolant member 281-18 may be secured to left side wall 204, and refrigerated coolant members 281-9 and 281-8 and frozen coolant member 281-20 may be secured to right side wall 205 (see FIG. 9(*a*)). Next, inner pallet 291, together with payload 201 seated thereon, may be inserted through the open front end of the container and placed on bottom wall 203 (see FIG. 9(*b*)). It should be noted that the payload seated on inner pallet 291 should be centered on pallet 291 and that the payload should not have a footprint that exceeds that of pallet 291 (to avoid contact with rear wall 206 or front wall 207). Consequently, the maximum payload is 48" L×40" W×38.25" H. In addition, the payload should be braced with braces 301-1 through 301-4. (Braces 301-1 through 301-4 should be at the height of the payload and should be cut if necessary). The pallet should then be shrink wrapped. Placement markings may be provided on bottom wall 206 to facilitate proper placement of pallet 291 therewithin.

Next, coolant rack 271 may be mounted on pins 247-1 and 247-2 of left side 204 and of right side 205. Next, coolant members 281-1 through 281-5 may be placed on coolant rack 111, and coolant members 281-14 through 281-17 may be placed on coolant members 281-1 through 121-5 (see FIG. 9(*c*)). Next, frozen coolant member 281-19 may be placed against left side wall 204, and frozen coolant member 281-21 may be placed against right side wall 205. Next, front wall 207 may be inserted into sleeve 225 of bottom wall 203, with front wall 207 mating with left side wall 204 and right side wall 205, and top wall 202 may be coupled to left side wall 204, right side wall 205, rear wall 206, and front wall 207 (see FIG. 9(*d*)). Braces 303-1 through 303-4 (not shown) may then be placed on the exterior corners of the container and plastic straps may be wrapped around the container and the outer pallet.

Shipper 200 has been tested under both simulated ambient summer conditions and ambient winter conditions and has been successful in maintaining a full payload and a half payload within a temperature range of +2° C. to +8° C. for a minimum of 120 hours.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. An insulated pallet shipper comprising:

(a) an insulated container shaped to include a bottom wall, a top wall, a left side wall, a right side wall, a rear wall and a front wall, the walls collectively defining a cavity including a space for a payload; and (b) a plurality of coolant members positioned within the cavity, at least some of the coolant members disposed laterally relative to the payload space and being mounted on at least one of the left side wall and the right side wall, each of the coolant members including a plurality of stacked, individually-wrapped coolant bricks encased within a single cardboard container, the single cardboard container comprising a closed-ended sleeve, wherein each of the stacked, individually-wrapped coolant bricks comprises a foam refrigerant block encased in a flexible metal foil.

2. The insulated pallet shipper as claimed in claim 1 wherein at least some of the coolant members are preconditioned at a refrigerating temperature and at least some of the coolant members are preconditioned at a freezing temperature, wherein the freezing temperature is a lower temperature than the refrigerating temperature.

3. The insulated pallet shipper as claimed in claim 1 further comprising a coolant tray, the coolant tray being positioned within the cavity of the insulated container above the space for the payload, wherein at least one coolant member is positioned on the coolant tray.

4. The insulated pallet shipper as claimed in claim 3 wherein the coolant tray is removably mounted on opposing side walls of the insulated container.

5. The insulated pallet shipper as claimed in claim 1 wherein each of the left side wall and the right side wall releasably interlocks with each of the front wall and the rear wall, wherein each of the left side wall, the right side wall, the rear wall, and the front wall releasably interlocks with each of the bottom wall and the top wall, and wherein each of the left side wall, the right side wall, the rear wall, the front wall, the bottom wall and the top wall comprises a body of foamed polymer material covered with a corrugated cardboard material.

6. The insulated pallet shipper as claimed in claim 1 wherein at least one of the left side wall and the right side wall receives at least one coolant member.

7. The insulated pallet shipper as claimed in claim 1 wherein each of the left side wall and the right side wall receives a plurality of coolant members.

8. The insulated pallet shipper as claimed in claim 1 wherein the left side wall and the right side wall are substantially identical to one another, each including a horizontal projection upon which at least one coolant member is directly seated.

9. The insulated pallet shipper as claimed in claim 1 further comprising an outer pallet, the insulated container being seated on the outer pallet.

10. The insulated pallet shipper as claimed in claim 1 further comprising an inner pallet, the inner pallet being seated on the bottom wall of the insulated container.

11. An insulated pallet shipper comprising:

(a) an insulated container shaped to include a bottom wall, a top wall, a left side wall, a right side wall, a rear wall and a front wall, the walls collectively defining a cavity including a space for a payload; and (b) a plurality of coolant members positioned within the cavity, each of the coolant members including a plurality of individually-wrapped coolant bricks encased within a single cardboard container;

(c) wherein the left side wall and the right side wall are substantially identical to one another, each including a horizontal projection upon which at least one coolant member is directly seated and wherein each of the left side wall and the right side wall further includes additional projections that separate adjacent coolant members.

12. An insulated pallet shipper comprising:

(a) an insulated container shaped to include a bottom wall, a top wall, a left side wall, a right side wall, a rear wall and a front wall, the walls collectively defining a cavity;

(b) a plurality of coolant members positioned within the cavity, each of the coolant members including a plurality of coolant bricks encased within a single cardboard container; and (c) a coolant tray, wherein the coolant tray is disposed within the cavity and wherein at least one of the coolant members is positioned on the coolant tray;

(d) wherein the left side wall and the right side wall are substantially identical to one another, each including a horizontal projection upon which at least one coolant member is directly seated, wherein each of the left side wall and the right side wall further includes additional projections that separate adjacent coolant members, wherein at least some of the additional projections include pins, and wherein the coolant tray is mounted on the pins.

13. An insulated pallet shipper for transporting a payload, the insulated pallet shipper comprising:

(a) an insulated container shaped to include a bottom wall, a top wall, a left side wall, a right side wall, a rear wall, and a front wall, the walls collectively defining a cavity, the cavity including a space for the payload;

(b) a coolant tray, the coolant tray being disposed within the cavity and spaced above the payload, wherein the coolant tray is removably mounted on the left and right side walls; and (c) a plurality of coolant members positioned within the cavity, each of the coolant members including a plurality of coolant bricks encased within a single cardboard container, each of the coolant bricks comprising a foam refrigerant block encased in a flexible metal foil, at least some of the coolant members lying on top of the bottom wall below the payload, at least some of the coolant members being mounted on the interior of the left side wall and the interior of the right side wall and disposed laterally relative to the payload space, and at least some of the coolant members lying on top of the coolant tray.

14. The insulated pallet shipper as claimed in claim 13 wherein at least some of the coolant members are preconditioned at a refrigerating temperature and at least some of the coolant members are preconditioned at a freezing temperature, wherein the freezing temperature is a lower temperature than the refrigerating temperature.

15. The insulated pallet shipper as claimed in claim 13 further comprising an outer pallet, the insulated container being seated on the outer pallet.

16. The insulated pallet shipper as claimed in claim 15 further comprising an inner pallet, the inner pallet being seated on the bottom wall of the insulated container.

17. An insulated pallet shipper for transporting a payload, the insulated pallet shipper comprising:

(a) an insulated container shaped to include a bottom wall, a top wall, a left side wall, a right side wall, a rear wall, and a front wall, the walls collectively defining a cavity, wherein the bottom wall and the top wall are substantially identical, the bottom wall being a generally rectangularly-shaped structure including a flat bottom, a top, a flat front, a flat rear, a flat left side and a flat right side, the top being shaped to include a lip and a plurality of blocks, the lip and the blocks together defining a groove adapted to receive the bottom ends of the left side wall, the right side wall, the rear wall, and the front wall;

(b) a coolant tray, the coolant tray being disposed within the cavity and spaced above the payload; and (c) a plurality of coolant members positioned within the cavity, each of the coolant members including a plurality of coolant bricks encased within a cardboard container, at least some of the coolant members lying on top of the bottom wall below the payload, at least some of the coolant members being positioned along the interior of the left side wall and the interior of the right side wall, and at least some of the coolant members lying on top of the coolant tray.

18. The insulated pallet shipper as claimed in claim 17 wherein the blocks include a central block and a pair of side blocks, the central block being divided by a plurality of projections into a left portion and a right portion, the left portion receiving two coolant members, the right portion receiving two coolant members, the pair of side blocks and the projections having a height exceeding that of the coolant members.

19. An insulated pallet shipper comprising:

(a) an insulated container, said insulated container being shaped to include a bottom wall, a top wall, and four side walls, the six walls collectively defining a cavity, each of the bottom wall, the top wall, and two opposing side walls being shaped to receive coolant;

(b) a coolant tray, said coolant tray being removably mounted on two opposing side walls of the insulated container;

(c) a plurality of coolant members, at least one coolant member being received in the bottom wall, at least one coolant member being received in the top wall and being positioned over the coolant tray, and at least one coolant member being received in each of two opposing side walls, wherein at least some of said coolant members are preconditioned at a refrigerating temperature and at least some of said coolant members are preconditioned at a freezing temperature, each of the coolant members including a plurality of coolant bricks encased within a single sleeve; and (d) an inner pallet, the inner pallet being seated on the bottom wall of the insulated container.

* * * * *